United States Patent [19]

Dana, III

[11] 3,946,505

[45] Mar. 30, 1976

[54] SHOE WITH DETACHABLE ILLUMINATED HEEL

[76] Inventor: Alfred Dana, III, 5700 Mariner, Apt. 306-W, Tampa, Fla. 33609

[22] Filed: Oct. 4, 1974

[21] Appl. No.: 512,304

Related U.S. Application Data

[63] Continuation-in-part of Ser. No. 493,610, July 31, 1974.

[52] U.S. Cl. ..... 36/2.5 K; 36/36 R

[51] Int. Cl.[2] ..... A43B 00/00

[58] Field of Search ..... 36/2.5 R, 2.5 K, 2.6, 36 R, 36/36 A, 36 B, 36 C

[56] References Cited

UNITED STATES PATENTS

| | | | |
|---|---|---|---|
| 1,597,823 | 8/1926 | Randolph | 36/2.5 K |
| 2,806,302 | 9/1957 | Sharpe | 36/36 R |
| 2,941,315 | 6/1960 | Irving et al. | 36/2.5 K |
| 3,159,928 | 12/1964 | Clark | 36/36 R |

FOREIGN PATENTS OR APPLICATIONS

| | | | |
|---|---|---|---|
| 570,614 | 9/1958 | Belgium | 36/2.5 K |

*Primary Examiner*—Patrick D. Lawson
*Attorney, Agent, or Firm*—Cushman, Darby & Cushman

[57] ABSTRACT

A shoe and a detachable transparent heel therefor. A beveled portion on the bottom back of a shoe upper cooperates with a rim portion having beveled edges formed on the top of a transparent heel. A latching means on the shoe upper selectively allows or prevents movement of the heel — when assembled with the shoe upper — away from the shoe sole. A light bulb and associated electrical components mounted on a printed circuit board are readily insertable into a cavity formed in the heel and communicating with the top and front portions thereof. Bores for receipt of an e.m.f. source or sources may also be provided in the heel.

8 Claims, 11 Drawing Figures

Fig. 1
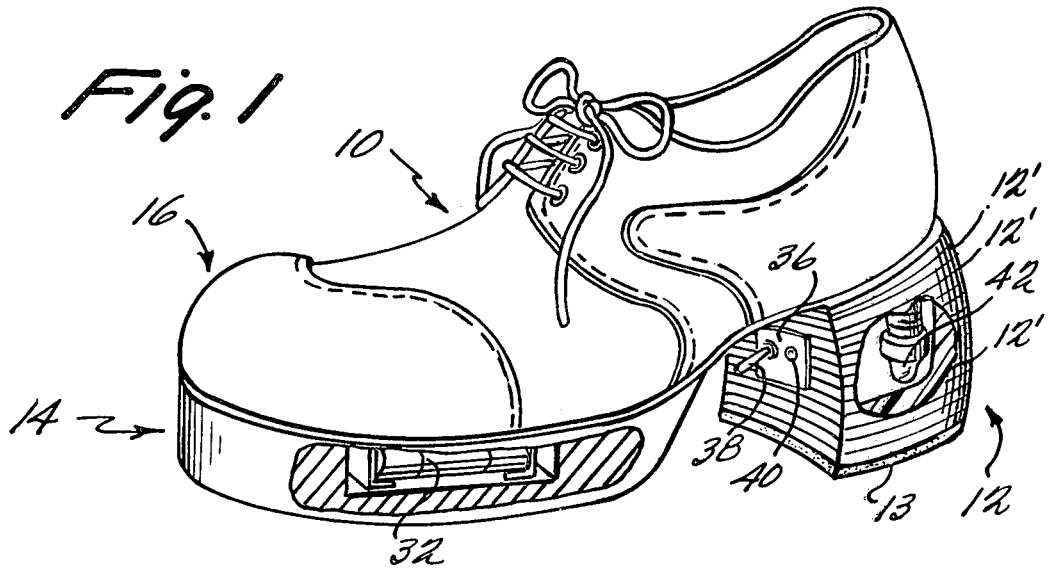
Fig. 2
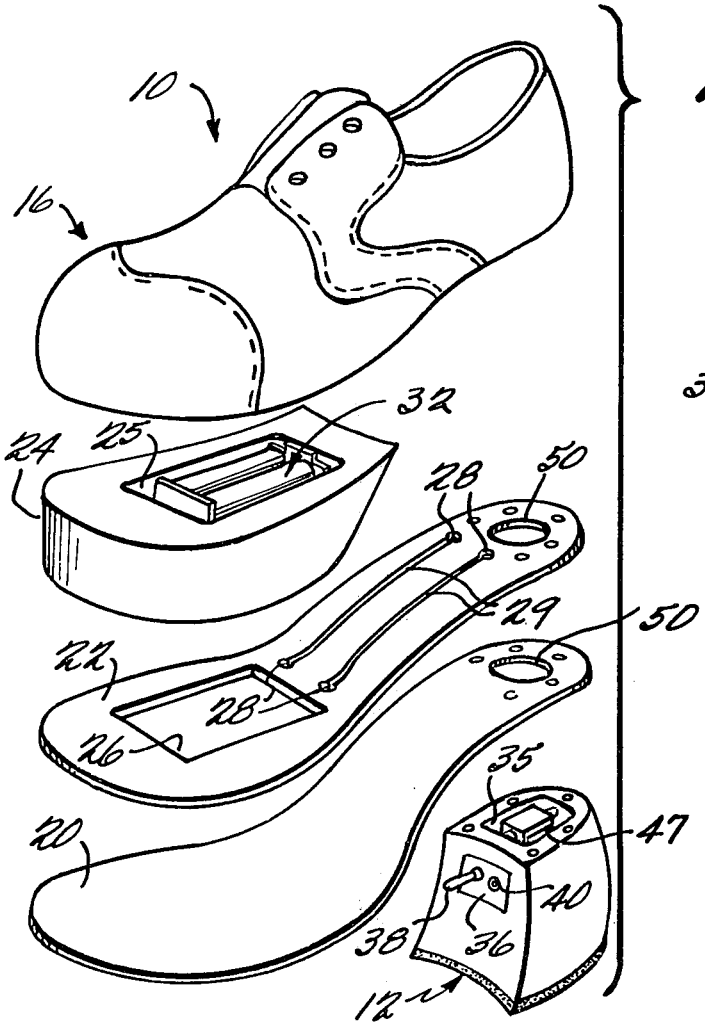
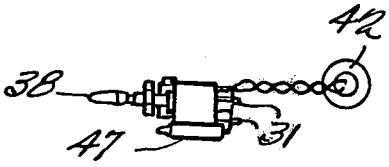
Fig. 4a
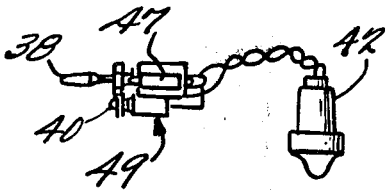
Fig. 4b

SHOE WITH DETACHABLE ILLUMINATED HEEL

CROSS-REFERENCE TO RELATED APPLICATIONS

This application is a continuation-in-part of Ser. No. 493,610, filed July 31, 1974.

BACKGROUND AND SUMMARY OF THE INVENTION

The invention relates to shoes with illuminated portions, and especially to shoes with transparent heels having a bulb and associated means therein for illumination thereof. According to one embodiment of the present invention, as shown in parent application Ser. No. 493,610, filed July 31, 1974, batteries for a lighted heel are disposed in a platform sole in order to maintain the structural integrity of the heel, and in order to provide for more area for related circuitry within the heel itself. While such an embodiment is very useful and practical, in some circumstances where a less expensive model is desired, where structural integrity of the heel can be assured even with a large number of bores therein, and where ease of replacement of all the electrical components of the shoe are required, another embodiment of the invention is desirable.

According to the first embodiment of the present invention, means are provided in the sole of the shoe for retaining a source of e.m.f. for energizing lights associated with the shoes, which means provides a large enough area for incorporating almost any type of battery or current source without impairment of the support function of the sole. Also, a mercury or other tilt switch is provided for selectively cutting out or on the shoe lights in response to shoe position, doing away with the necessity of cumbersome, often ineffective weight responsive means, and increasing the variety of shoe positions to which the cutoff or cutout means may be responsive.

Additionally, according to the present invention, a three-position switch is provided for either turning the shoe lights on continuously, or bringing the tilt switch into the circuit, making the shoe lights shoe position responsive. Additionally, a battery recharging means may be provided for allowing power source recharging without the need for disassembling and possibly damaging the shoes. In most prior art devices, such a means would not even be contemplated since the batteries and power sources that, of necessity (i.e. because of space limitations), had to be used were not rechargeable (i.e. dry cells).

According to the second embodiment of the present invention, bores are provided within the shoe heel for receipt of batteries therein, and another cavity is formed in the heel for receipt of the other electrical components which include a mercury switch, light bulb, and battery contacts all mounted on a printed circuit board. The heel is detachable from the shoe by merely releasing a latching means and moving the heel relative to the shoe, beveled interengaging surfaces of the shoe and the heel providing for the secure but detachable connection.

Thus, according to the teachings of the present invention, shoes having lighted portions thereof are provided that are improved over the prior art devices for almost any purpose — whether decorative or functional — to which the shoes would be put while, at the same time, the possibilities of light response to various shoe positions are greatly increased.

BRIEF DESCRIPTION OF THE DRAWINGS

FIG. 1 is a perspective view of an exemplary shoe embodying the teachings of the first embodiment of the present invention;

FIG. 2 is an exploded view of the shoe illustrated in FIG. 1;

FIG. 4*a* is a top plan view of an exemplary switch and bulb and mounting means associated therewith for use in the circuit shown in FIG. 3*a*, and FIG. 4*b* is a side view of the apparatus shown in FIG. 4*a;*

DETAILED DESCRIPTION OF THE DRAWINGS

Figure 3A:
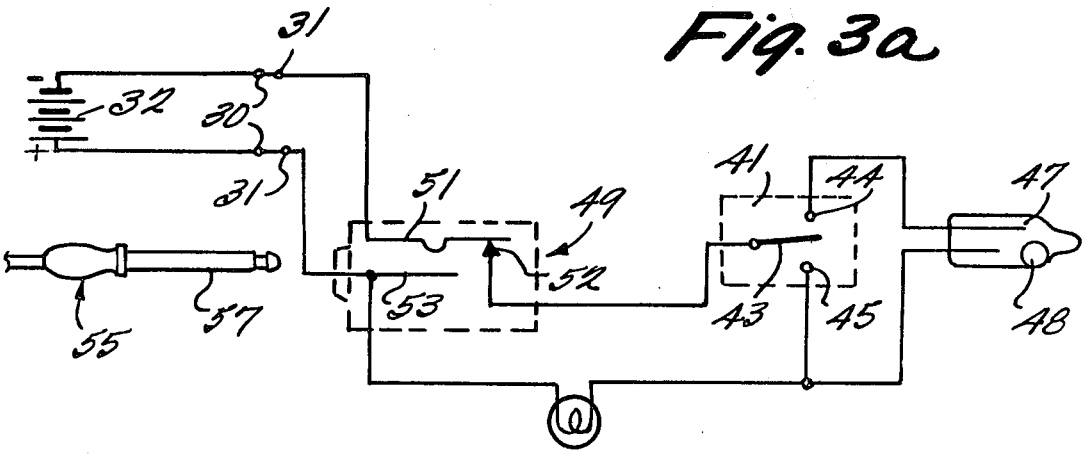
FIGS. 3*a* and 3*b* are exemplary circuit diagrams for shoes embodying the teachings of the present invention.
Figure 3B:
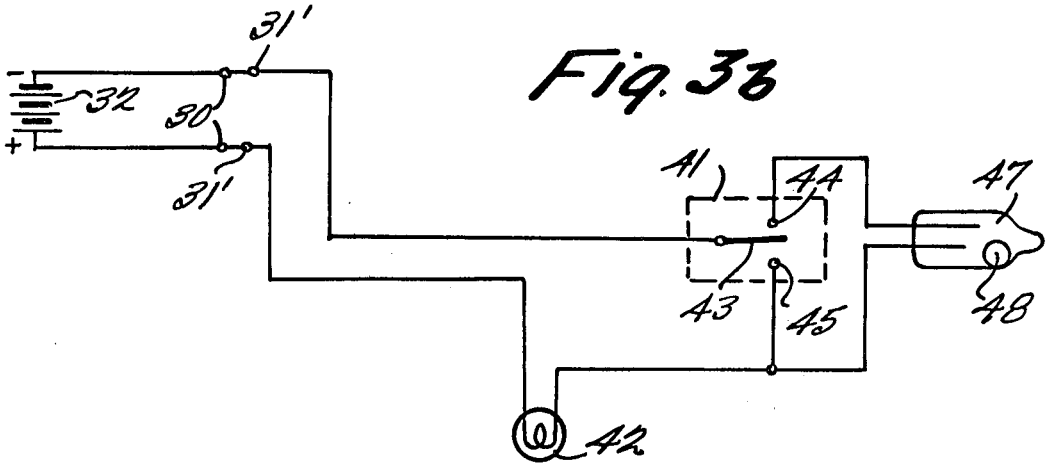
Figure 5A:
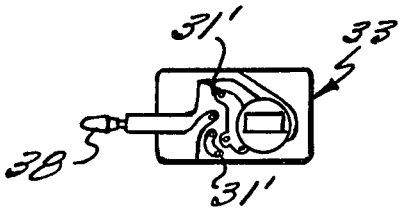
FIGS. 5*a* and 5*b* are top and side views respectively of a switch, printed circuit, and associated means for use in the circuit shown in FIG. 3*b;*
Figure 5B:
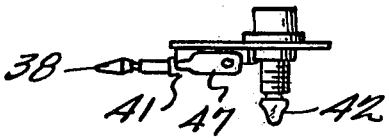

FIG. 1 is a perspective view of an exemplary lighted shoe according to the teachings of the present invention, which shoe may be worn either for decorative or aesthetic appeal, or for providing a means for illuminating a path on which the wearer is walking, for providing visibility of the wearer when bicycling or walking at night, or for a myriad of other purposes. The shoe 10 may comprise generally a transparent heel portion 12, a platform sole 14, and an upper 16 of any suitable style or construction.

As shown most clearly in FIG. 2, the sole 14 comprises a bottom portion 20 that is adapted to be fastened to the heel 12 and to engage the ground when the shoe 10 is worn, and an insole 22 that is adapted to be sandwiched between the sole 20 and a platform sole 24. The insole 22 has an opening 26 therein and contacts 28 adjacent thereto, with wires 29 leading from contacts 28 to contacts 30 located above heel 12 when the shoe components are assembled. The platform sole 24 has an opening 25 therein adapted to receive a battery 32 — such as a nickel-cadmium battery — or other suitable source of e.m.f. The hole 25 cooperates with the hole 26 in the insole 22, the battery 32 also being received by the hole 26 and having contacts thereon adapted to operatively cooperate with contacts 28 on insole 22. Preferably, the shoe has a covering (not shown) therein to be disposed over the platform 24 and insole 22 to contact the wearer's foot. The covering may be removed and easy access thereby gained to the battery or batteries 32 with the platform 24, and also — through apertures 50 — to the electrical components within the heel 12 so that both the battery 32 and other electrical components may be quickly replaced without requiring shoe disassembly.

The heel 12 is preferably formed of a hard transparent material such as acrylic or lucite (sturdy enough to serve as a shoe heel). As shown in FIG. 1, the heel may be formed of layers 12' each of a different color and of various sizes to provide an unusual visual effect. The heel may have a ground-engaging portion 13 at the bottom thereof which portion 13 may be formed of rubber or leather or the like and be adapted to be replaced when worn down. Located within heel 12 may be a cavity 35 adapted to receive various electrical components to be further described, and on the outside front face of the heel 12 preferably is located a plate 36 having a toggle switch actuator 38 and recharger orifice 40 received therein.

As shown most clearly in FIGS. *3a* and *4a* and *4b*, the electrical components received by the cavity 35 and plate 36 preferably are a three-way switch 41 for actuation of toggle actuator 38, a light bulb 42, a tilt switch 47, and a charging switch 49, contacts 31 providing connection between contacts 30 (and e.m.f. source 32) and the rest of the electrical components. Preferably, the three-way switch 41 comprises a movable contact 43 and stationary contacts 44 and 45, the movable contact 43 adapted to be moved either into contact with contacts 44 or 45, or into a center "off" position. When the contact 43 is in engagement with contact 44, the tilt or mercury switch 47 is inserted into the circuit whereby energization of the bulb 42 occurs when the shoe 10 is so positioned that the tilt switch 47 is closed. When the contact 43 engages contact 45, the mercury switch 47 is bypassed and the bulb 42 is constantly energized, the circuit from battery 32 always being complete.

Preferably the tilt switch 47 is a mercury switch that — once it is tilted — will provide for oscillation of the mercury 48 therein back and forth to intermittently make and break the contacts of the switch 47 thereby causing flashing of the light 42 on and off. The mercury will stop oscillating once the shoe remains in a certain orientation for a predetermined amount of time (dependent upon the design of the switch 47).

A charging switch 49 is preferably employed in all situations where the e.m.f. source is rechargeable — such as a nickel-cadmium battery — thereby eliminating the necessity of taking the shoe apart when the battery wears out, as is necessary with prior art devices which utilize dry cell batteries, or removing the covering of the platform 24 as is possible with the present invention. The charging switch 49 may be of the type having a movable cammable contact 51 normally biased into contact with stationary contact 52 to complete the circuit from battery 32 to the electrical components within heel 12, and another stationary contact 53 for cooperation with a recharger plug 55 for providing a recharging circuit for the battery 32. When the tip portion 57 of the recharger plug 55 is inserted into opening 40 of switch 49, it cams contact 51 out of engagement with contact 52 and, at the same time, completes a contact between contact 53 and contact 51 through any suitable recharging means with which the plug 55 is associated. Upon withdrawal of tip 57 of plug 55 after recharging, the contact 51 will again return to engagement with contact 52.

A modification of the electrical components shown in FIGS. *3a*, *4a* and *4b* is shown in FIGS. *3b*, *5a* and *5b*. In this modification, the charging switch 49 is eliminated, and the contact 31' for making contact with contacts 30 leading to battery 32 are formed on a printed circuit board 33 which mounts the switch 41, tilt switch 47, and bulb 42. As with the modification of FIGS. *4a* and *4b*, with this modification the cavity 35 for mounting the electrical components within the heel 12 need not be formed so large that the structural integrity of the heel is impaired, diminishing its ability to perform its support function since the largest component — the e.m.f. source 32 — need not be incorporated therein.

The shoe 10 shown in FIG. 1 is used as follows: After the component parts of the shoe are assembled so that battery 32 operatively engages contacts 28 of insole 22 and contacts 30 of insole 22 engage contacts 31 in heel 12, the wearer may wear the shoe 10 just like any other shoe. The switch 41 will normally be in the middle "off" position with the blub 42 inoperative. If it is desired that the bulb 42 constantly be energized, the toggle actuator 38 is moved so that contact 43 comes into engagement with contact 45. If it is desired that the bulb 42 should be energized only when the shoe 10 is in a vertical position or in a horizontal position (depending upon the wiring and orientation of tilt switch 47) or that light 42 flash on and off when the shoe is moved from one orientation and then back in place, toggle 38 is moved so that contact 43 engages contact 44, thereby inserting the tilt switch 47 into the circuit between battery 32 and bulb 42. After extended use when the battery 32 is worn down, the tip 57 of recharging plug 55 is inserted into opening 40 in heel 12, and the battery 32 is recharged, of the covering for platform 24 and apertures 50 may be removed and the various components readily replaced.

Figure 6:
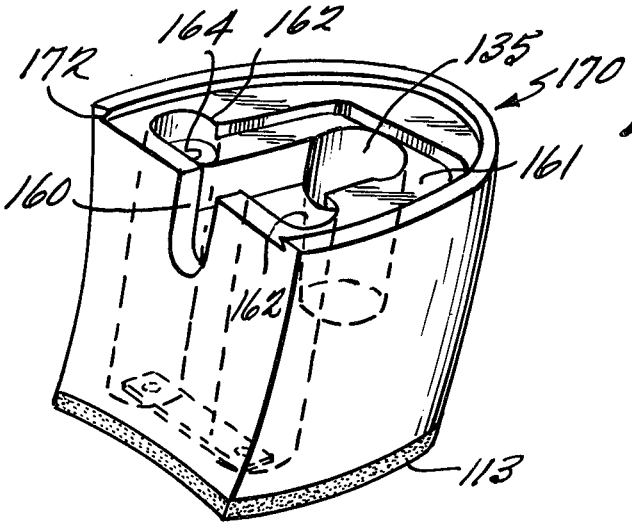
FIG. 6 is a perspective view of a second embodiment of a heel according to the present invention.
Figure 7:
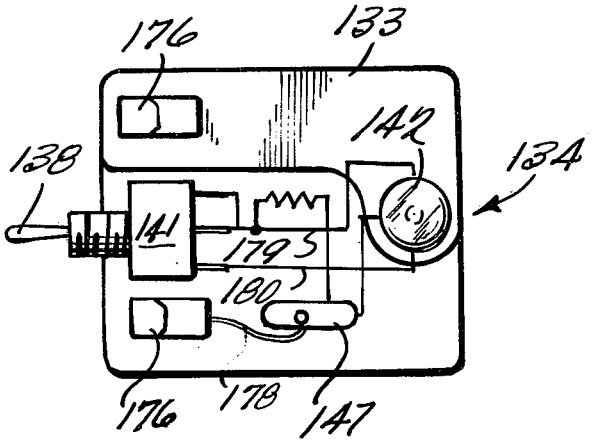
FIG. 7 is a bottom plan view of an electrical assembly for use with the heel shown in FIG. 6.
Figure 8:
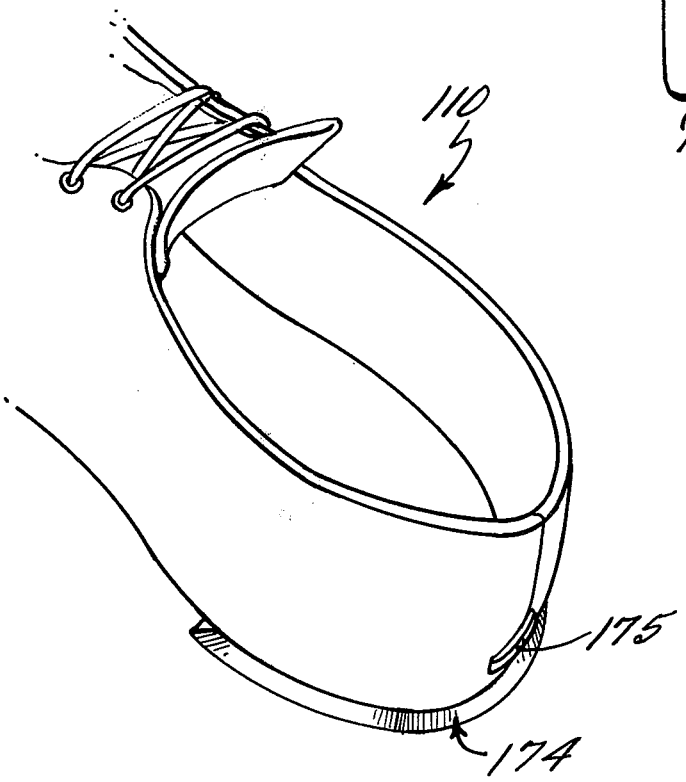
FIG. 8 is a perspective view of a shoe upper for cooperation with the heel shown in FIG. 6.

A second embodiment of a shoe according to the present invention is shown in FIGS. 6–8. In FIG. 6 a shoe heel 112 is shown, said heel being formed of acrylic or the like. This heel would normally be used where the materials forming the heel are strong enough so that the structural integrity of the heel will not be impaired by the formation of bores for an e.m.f. source therein, and in situations where it is desirable to provide for ready replacement of all the electrical components in a heel or of the heel itself so that a lighted heel may be replaced by a conventional or other special use heel.

The heel 112 preferably has a pair of bores 162 therein, each for receipt of an e.m.f. source (such as dry cell battery 164, only one of which is shown in FIG. 6). Electrical communication between the e.m.f. sources 164 within the bores 162 is provided by any suitable means such as a bridging piece of metal, shown in dotted line at 166 in FIG. 6, extending from the bottom of one bore to the bottom of the other. A heel plate 113, formed of leather, rubber, or the like, covers the bottom of heel 112.

Formed near the middle of the heel 112 is a cavity 135, said cavity communicating with the top 161 and front 160 of the heel 112, and for receipt of electrical assembly 134. The assembly 134 includes a three-position switch 141 having actuator 138 extending therefrom and mounted to printed circuit board 133. Printed circuit board 133 has contacts 176 formed thereon for cooperation with the e.m.f. sources 164 in bores 162. Printed lead 178 extends from switch 141 through tilt switch 147 to bulb 142, both of which are also mounted on board 133, printed lead 179 extends from switch 141 directly to bulb 142, and lead 180 extends from bulb 142 to switch 141. Operation of the electrical components of this embodiment of the invention is the same as for the first embodiment (see FIG. *3b*).

The heel 112 is formed so that it is readily detachable from a shoe 110, but so that when attached thereto positive securement thereto and positive operation of the electrical components thereof are assured. This detachable feature is preferably provided by a rim portion shown generally at 170, formed around the upper periphery 161 of the heel 112 (except for the front 160) for cooperation with beveled member 174 formed on the heel portion of shoe 110. Beveled edge 172 of portion 170, when the heel 112 is slid over the portion 174, cooperates with the beveled edge of portion 174 to provide for secure attachment of the heel 112 to the shoe 110 by preventing relative movement therebetween (once the heel is completely on the shoe) in the direction toward the sole and in either side direction. It will be also noted that the member 174 can be designed to exert a downward bias on the electrical assembly 134 disposed within the heel cavity 135. Movement of the heel 112 away from the sole may be prevented by any suitable means. As shown in the drawings, a simple pivoted level 175 is provided which is mounted on the shoe 110 and may be pivoted with respect thereto to a position in which it blocks the heel 112 or in which it allows movement of heel 112 away from the shoe sole; other heel latching means, including springloaded means, could be provided.

Thus, according to the second embodiment of the invention shoes and a heel therefore have been provided that allow for ready detachment of the heel from the shoe, and provide means for illuminating the heel that are easy to replace and which allow a great deal of versatility in condition responsiveness of the lighted heel.

While the invention has been shown in what is presently conceived to be the most practical and preferred embodiments, it will be apparent to one of ordinary skill in the art that many modifications may be made thereof within the scope of the invention. For instance, a plurality of bulbs 42 may be provided, located in or on various parts of the shoe such as exteriorly mounted on the toe or sides, or a number of different ones within the heel itself. Also, the switch 41 need not have a toggle actuator therefor, but may be of any suitable type, as may the recharging switch 49. Although a mercury switch has been disclosed for the switch 47, other suitable tilt responsive switches may be utilized; the tilt switch can be arranged with respect to the shoe so that is is adapted to be closed upon any predetermined orientation or orientations of the shoe. Other modifications are also possible, thus the invention is not to be limited to what has been herein illustrated, but is to be accorded the full scope of the appended claims to encompass all equivalent structures and devices.

What is claimed is:

1. A shoe comprising a. a shoe upper, b. a sole, c. a transparent heel, said heel having formed therein a first cavity receiving a source of e.m.f. and a second cavity receiving an electrical assembly, said electrical assembly comprising a light bulb mounted on a printed circuit board and circuits on said board for providing electrical connection of a source of e.m.f. mounted in said first cavity to said light bulb, a three-position electrical switch mounted on said board and disposed in the circuits formed on said printed circuit board, and a mercury tilt switch disposed in a circuit between said switch and said light bulb, whereby said light bulb may be off, continuously on, or flashing on and off in response to heel movement, dependent upon the position of said three-position switch, d. means for providing a secure but readily detachable connection between said heel and said upper, and e. releasable means for either preventing or allowing relative movement of said heel with respect to said shoe upper in the direction away from said sole.

2. A shoe as recited in claim 1 wherein said second cavity in said heel communicates with the front and top portions of said heel, and wherein said electrical switch is positioned in said cavity so that an actuator therefor extends outwardly from the front of said heel near the top thereof.

3. A shoe as recited in claim 1 wherein said heel has a third cavity formed therein adapted to receive a source of e.m.f., each of said first and third cavities comprising a bore extending from the top of said heel toward the bottom thereof, and a means for electrically interconnecting e.m.f. sources disposed in said bores, said means including an electrically conducting member disposed within said heel and interconnecting the bottoms of said bores.

4. A shoe as recited in claim 1 wherein said means for providing a secure but readily detachable connection between said heel and said upper includes a plate portion formed on the bottom of said shoe upper near the back and partially around the sides thereof, said plate portion having a beveled edge formed around the periphery thereof corresponding to said shoe upper back and sides, and a rim portion formed on the upper surface of said heel around the back and sides thereof, said rim portion having a beveled portion formed thereon for cooperation with said beveled portion on said shoe upper, the cooperation of said side and back beveled portions preventing relative movement of said heel with respect to said shoe upper toward said sole or from side-to-side when said shoe upper and heel are assembled together.

5. A readily attachable-detachable shoe heel comprising a. a transparent body member having generally flat top, bottom, front and side portions, and a generally arcuate back portion, b. means defining a first cavity in said body member, said first cavity being open at the top of said heel body member and adapted to receive a source of e.m.f., c. means defining a second cavity in said body member, said second cavity being open at the top of said body member and adapted to receive an electrical assembly including a light bulb, and d. an electrical assembly disposed in said second cavity, said assembly including a light bulb mounted on a printed circuit board and circuits on said board for providing electrical connection of a source of e.m.f. mounted in said first cavity to said light bulb, a three-position electrical switch mounted on said board and disposed in the circuits formed on said printed circuit board, and a mercury tilt switch disposed in a circuit between said switch and said light bulb, whereby said light bulb may be off, continuously on, or flashing on and off in response to heel movement, dependent upon the position of said three-position switch.

6. A heel as recited in claim 5 wherein said second cavity in said body member communicates with the front and top portions of said body member, and wherein said electrical switch is positioned in said cavity so that an actuator therefor extends outwardly from the front of said body member near the top thereof.

7. A heel as recited in claim 5 wherein said body member has a third cavity formed therein adapted to receive a source of e.m.f., each of said first and third cavities comprising a bore extending from the top of said body member toward the bottom thereof, and a means for electrically interconnecting e.m.f. sources disposed in said bores, said means including an electrically conducting member disposed within said body member and interconnecting the bottoms of said bores.

8. A readily attachable-detachable shoe heel comprising a. a transparent body member having generally flat top, bottom, front and side portions, and a generally arcuate back portion, b. means defining a first cavity in said body member, said first cavity being open at the top of said heel body member and adapted to receive a source of e.m.f., c. means defining a second cavity in said body member, said second cavity being open at the top of said body member and adapted to receive an electrical assembly including a light bulb, d. an electrical assembly disposed in said second cavity, said assembly including a light bulb mounted on a printed circuit board, and circuits on said board for providing electrical connection of a source of e.m.f. mounted in said first cavity to the light bulb, and e. means defining a third cavity formed in said body member, said third cavity adapted to receive a source of e.m.f., each of said first and third cavities comprising a bore extending from the top of said body member toward the bottom thereof, and a means for electrically interconnecting e.m.f. sources disposed in said bores, said means including an electrically conducting member disposed within said body member and interconnecting the bottoms of said bores.

* * * * *